United States Patent [19]

Flamand

[11] 4,010,776

[45] Mar. 8, 1977

[54] TAPE WHEEL FOR SHUTTLELESS LOOMS

[75] Inventor: Maurice Flamand, Cumberland, R.I.

[73] Assignee: Rockwell International Corporation, Pittsburgh, Pa.

[22] Filed: Nov. 28, 1975

[21] Appl. No.: 635,875

[52] U.S. Cl. ..... 139/449; 226/173; 226/183

[51] Int. Cl.[2] ..... D03D 47/18

[58] Field of Search ..... 139/449; 226/173, 183; 74/89.2, 89.22, 661

[56] References Cited

UNITED STATES PATENTS

| | | | |
|---|---|---|---|
| 2,869,865 | 1/1959 | Lechner | 226/173 |
| 3,032,247 | 5/1962 | Lechner | 226/173 |
| 3,159,184 | 12/1964 | Brown et al. | 139/449 |
| 3,220,627 | 11/1965 | Nussbaum | 226/173 |

FOREIGN PATENTS OR APPLICATIONS

| | | | |
|---|---|---|---|
| 2,502,692 | 9/1975 | Germany | 139/449 |

*Primary Examiner*—Henry S. Jaudon

[57] ABSTRACT

An improved tape wheel for shuttleless looms having flexible guide members carried thereon for retaining a flexible tape in close proximity with the outer periphery of the tape wheel and for releasing the same therefrom during the tape's function of inserting and withdrawing a weft carrier from a shed of warp threads.

5 Claims, 6 Drawing Figures

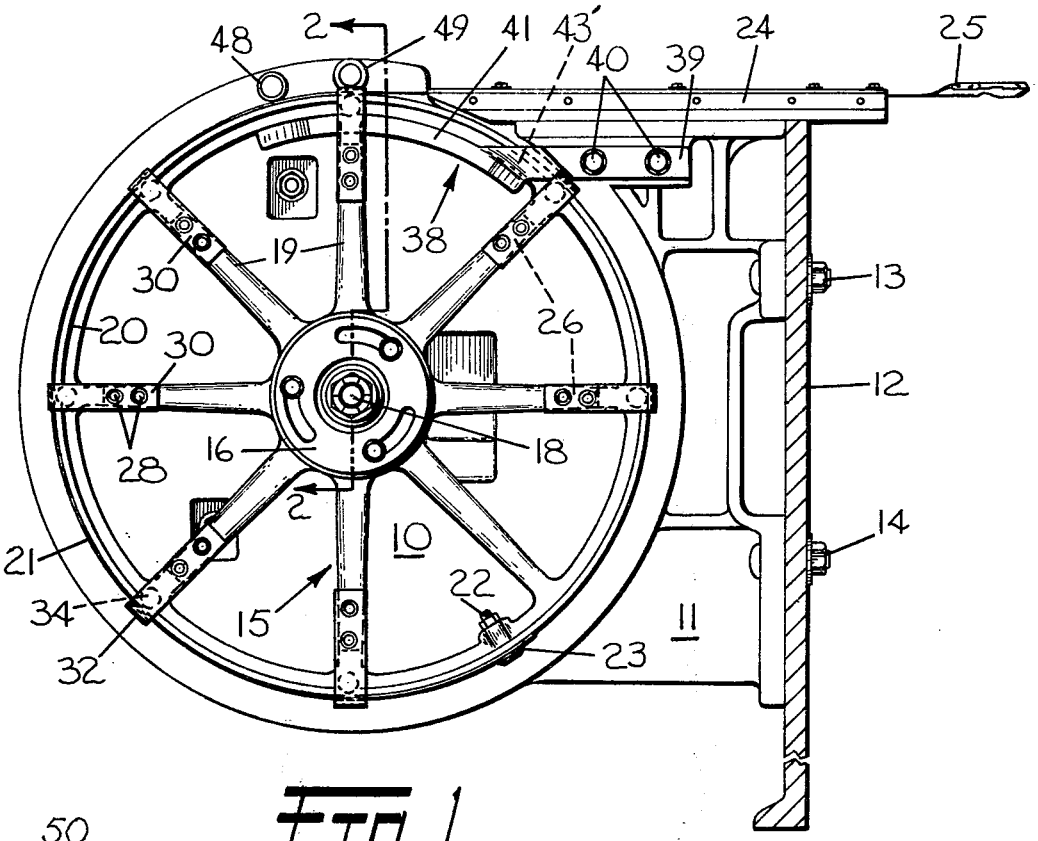
Fig. 1
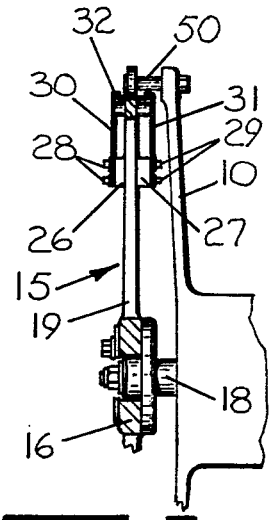
Fig. 2
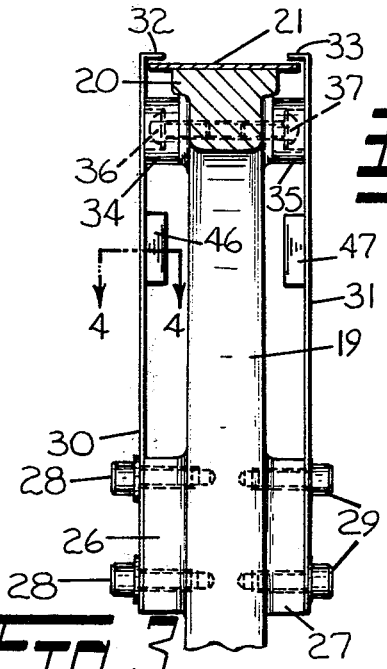
Fig. 3
Fig. 4
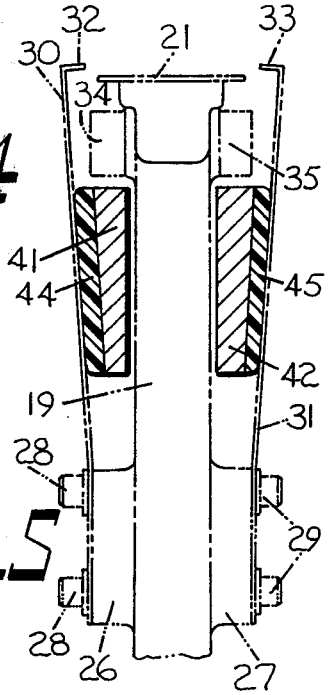
Fig. 5
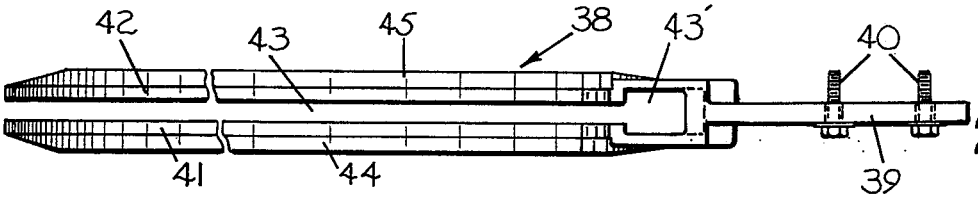
Fig. 6

TAPE WHEEL FOR SHUTTLELESS LOOMS

BACKGROUND OF THE INVENTION

Shuttleless looms of the type to which the present invention is applicable have opposed carrier elements which are attached to the free ends of flexible tapes. The opposite ends of these tapes are fixed to a point on the outer peripheral surface of oscillating tape wheels disposed at the sides of a loom. The carrier elements are caused to enter a warp shed and to be withdrawn therefrom by the wrapping and unwrapping of the flexible tapes on and from their respective tape wheel.

As is well known to those familiar with the art, this type of loom utilizes an outside source of weft, that is, the supply is not carried to and fro through the warp shed by a shuttle or the weft inserting member itself. The weft yarn is measured and cut to the required length for extending across the width of the fabric being woven.

A first carrier inserts the weft into the warp shed to a point adjacent the center thereof where it is then transferred to a second carrier member which extends it through the remaining portion of said shed to complete the laying of a single pick.

The tape wheels are oscillated slightly less than a full revolution and as the tapes are being withdrawn from the shed they are wrapped tightly about the peripheral surface thereof. When the tapes are being unwrapped or extended from their respective wheel and inserted into the shed, guide elements are required to hold them radially inward and in close proximity with the rim of said wheels.

A number of U.S. Patents describe and clearly illustrate the looms and mechanism for actuating flexible tapes and carriers by means of oscillating tape wheels and it is considered unnecessary at this point to insert herein a detailed description of the mechanisms. Attention is hereby drawn to U.S. Pat. Nos. 2,604,123 and 2.810,403.

A common form of guide element utilized for maintaining the flexible tapes in close proximity with the rims of tape wheels is that of a plurality of arcuate shoe members made of such materials as impregnated wood or plastic. Additionally, other forms of guide elements have included devices such as a plurality of roller members for restraining the flexible tapes.

The known forms of tape restraining devices have not proven to be entirely satisfactory for, in most cases, considerable wear is introduced, and friction and heat are generated through the pressure of the moving tapes against their restraining means. The heat generated by the frictional contact of the tapes with the known forms of restraining devices, and especially the more common arcuated shoe type, is considered a problem, for excessive heating of the tapes will distort them to the extent where control of the tape and carrier settings at the weft transfer point is lost. Loss of this control often results in failure to transfer the weft from one carrier to the other as well as a more serious condition of carrier collision. A collision of the carrier members is known to be responsible for breakage of many warp yarns as well as resulting in excessive down time to replace or make the necessary repairs to the damaged carriers.

The present invention provides a tape wheel having a tape restraining means forming a part thereof which oscillates with the wheel and in timed relation to the weaving cycle is displaced to release the tape for insertion into a shed and thence returned to tape retaining position during the withdrawal of the tape from said shed. By having the tape restraining means mounted for movement with their respective tape wheels the above problem of generating excessive heat has been corrected thereby, providing a more positive control of the tapes and their carriers at the weft transfer point. Additionally, by eliminating the frictional contact between the tapes and the restraining means for holding them in close proximity with the rim of the wheel reduces substantially the power requirements for actuating the tape wheels.

SUMMARY OF THE INVENTION

The improved tape wheel of the present invention includes the usual hub having a plurality of spokes extending outwardly therefrom for supporting a rim upon which one end of a flexible tape is attached. The spoke members have flexible guide members attached in opposed relation to each side thereof and extending outwardly with their respective spoke members, their free ends define laterally extending lips that are effective in maintaining a flexible tape in close proximity with the rim of the tape wheel. A stationary bifurcated cam member of arcuated configuration is disposed so that the rim moves through the bifurcated portion of the cam during oscillation of the wheel which locates the camming surfaces of said cam in operative association with the spoke members and their respective flexible guide members. As the tape wheel is rotated to insert its flexible tape into a warp shed the cam member is effective in sequentially displacing the pairs of flexible guide members on each spoke so as to release the tape from the rim. When the tape wheel reverses its direction of travel so as to withdraw the tape from the shed, the cam is effective in sequentially returning the pairs of flexible guide members to their retaining position of maintaining said tape in close proximity with the peripheral surface of said tape wheel.

It is a general object of the invention to restrain the flexible tape from any radial motion away from the tape wheel while being inserted or withdrawn from the warp shed.

A further object is to devise a tape wheel to drive and retract a flexible tape without requiring the use of rollers or restraining shoes or pads.

A further object of the invention is that of substantially reducing the amount of friction and heat generated by eliminating the use of the above restraining means.

A more specific object is that of reducing the power requirements previously required to overcome friction between the tape and its restraining means.

Another more specific object is to provide improved control of tape settings at the weft transfer point through a reduction in heat formerly generated between the tapes and their restraining means.

These and other objects of the invention will become more fully apparent by reference to the appended claims and as the following detailed description proceeds in reference to the figures of drawing wherein:

BRIEF DESCRIPTION OF THE DRAWING

FIG. 1 is a view in side elevation of a portion of a shuttleless loom showing the improved tape wheel according to the invention applied thereto;

FIG. 2 is a view taken along line 2—2 in FIG. 1;

FIG. 3 is a view partially in section showing the flexible guide members and their association with the flexible tape for maintaining the latter in close proximity with the wheel's rim;

FIG. 4 is a view taken along line 4—4 in FIG. 3 showing the members attached to the flexible guide members for effecting their displacement by cam means;

FIG. 5 is a view similar to FIG. 3 but a modification thereof showing the wear resistant members forming a part of the cam means; and FIG. 6 is a top view of the arcuated cam member shown in FIG. 1.

DESCRIPTION OF THE PREFERRED EMBODIMENT

Referring to FIG. 1 of the drawing wherein only as much of a shuttleless loom structure is depicted as is necessary for a complete understanding of the invention there is shown a tape wheel housing 10 having on its inner side an integrally formed support bracket 11 which is assembled to the loomside 12 by means of bolts 13 and 14.

A tape wheel generally indicated by numeral 15 includes a hub 16 by which it is mounted for oscillating movement on a shaft 18 within the housing 10. A plurality of spoke members 19 extend outwardly from the hub 16 to support an outer rim 20 on which one end of a flexible weft carrier tape 21 is fixed by means of a bolt 22 as at 23.

As shown in FIG. 1, the conventional form of tape guide 24 is assembled on the upper end of the support bracket 11 and serves to guide the flexible tape 21 and the weft carrier 25 attached to the free end thereof in a horizontal path as they are inserted and withdrawn from a warp shed.

The spoke members, as shown in FIGS. 2, 3 and 5 are provided intermediate their ends with a pair of integrally formed bosses which are disposed in aligned relation on the forward and rearward sides of said spoke members. The bosses on the forward side of the spoke members are identified by numeral 26 and those on the rearward side by numeral 27.

A flexible guide member in the form of a leaf spring is attached to each boss 26 and 27 by means of cap screws 28 and 29 respectively. The flexible guide members attached to bosses 26 are identified by numeral 30 and those to bosses 27 by numeral 31. These flexible guide members 30 and 31 extend toward the outer rim 20 parallel with their respective spoke member 19 and the free ends thereof terminate in laterally extending lips 32 and 33 respectively (FIGS. 3 and 5). These lips 32 and 33 are directed one toward the other so that the ends thereof are in alignment and in overlying relation to the edges of the flexible tape 21 when the flexible guide members 30 and 31 are in that position shown in FIGS. 2 and 3. The flexible guide members 30 and 31 being fabricated from spring steel are continually urged to their free position which is parallel with their respective spoke member 19; however, in the position as shown in FIG. 3 they are maintained in a slightly flexed location by means of positioning stop elements 34 and 35 respectively. These positioning stop elements 34 and 35 are attached to each side of the outer rim 20 by means of screws 36 and 37 respectively and by maintaining the flexible guide members slightly flexed sufficient clearance is provided as shown in FIG. 3 to prevent contact between the sides of the flexible tape 21 and the upper inner sides of said flexible guide members.

Referring now to FIGS. 1 and 6 a cam member generally indicated by numeral 38 having an integral support arm 39 is attached to the tape wheel housing 10 adjacent the upper portion thereof by means of bolts 40. As shown in FIG. 6, cam 38 is bifurcated to define a pair of spaced arcuated cam members 41 and 42 that form a channel 43 therebetween. In operating position the channel 43 is located so that the outer rim 20 and the upper portion of the spokes 19 will pass therethrough during the oscillating movement of the tape wheel. Numeral 43' identifies an enlarged portion of channel 43 and serves to provide a clearance for the positioning stop elements 34 and 35 to pass through said channel. During this oscillating movement of the tape wheel the flexible guide members 30 and 31 contact the outer sides of the arcuated cam members 41 and 42 respectively which are effective in displacing said guide members from the tape retaining position of FIG. 3 to the release position of FIG. 5 and thence allow them to return to their tape retaining position.

As shown in FIG. 6 the arcuated cam members 41 and 42 have wear resistant members 44 and 45 respectively fixed to the sides thereof by any suitable means which serve to prevent frictional wear from developing between said arcuated cam members and the flexible guide members. A modification of this means for preventing this frictional wear is illustrated in FIG. 3 wherein the wear resistant members are fixed on the inner sides of the flexible guide members 30 and 31 by any suitable means not shown and are identified by numerals 46 and 47 respectively.

To summarize the operation, the tape wheel is oscillated first in one direction to insert its flexible tape 21 and carrier 25 carried thereby into a shed of warp thread and then to withdraw the same therefrom. The lips 32 and 33 of the flexible guide members are effective in maintaining the flexible tape 21 in close proximity with the outer rim 20 of the tape wheel. As each spoke member 19 enters channel 43 its flexible guide members 30 and 31 are flexed or cammed outwardly by their frictional contact with the arcuated cam members 41 and 42 to that position shown in FIG. 5. When the flexible guide members are cammed to the position shown in FIG. 5 the flexible tape leaves the outer rim to pass through the tape guide 24 and thence into a shed of warp threads not shown. When the flexible guide members are in position to release the tape from the outer rim 20 a pair of spaced roller members 48 and 49 (FIG. 1) are provided to prevent said tape from rising above its intended path of travel. These rollers are carried on the upper forward side of the tape wheel housing 10 and are carried on stud members 50 one of which is shown in FIG. 2. Continued movement of the tape wheel in the direction for inserting the flexible tape will cause the spoke member to move through channel 43 and beyond the arcuated cam members 41 and 42. In this position the flexible guide members again assume a substantially parallel position relative to their respective spoke member. When the tape wheel reverses its direction of travel to withdraw the flexible tape, the spoke members pass back through channel 43 and the arcuated cam member will again cam the flexible guide members 30 and 31 outwardly. As the flexible tape returns to the peripheral surface of the wheel the spoke members 19 will sequentially pass beyond channel 43 and move the flexible guide members out of contact with the arcuated cam members which will allow said guide members to return to their initial or tape retaining position shown in FIG. 3.

Although the present invention has been described in connection with a preferred embodiment, it is to be understood that modifications and variations may be resorted to without departing from the spirit and scope of the invention as those skilled in the art will readily understand.

Such modifications and variations are considered to be within the purview and scope of the invention and the appended claims.

I claim:

1. An improved tape wheel for use in a shuttleless loom in which flexible tapes are inserted into and withdrawn from the warp shed by being wrapped about and extended from said tape wheel respectively, said improved tape wheel comprising:

a. hub means journalled for effecting oscillation of said tape wheel;

b. a plurality of spoke members extending outwardly from said hub means;

c. outer rim means supported by said spoke members with attachment means for anchoring one end of a flexible tape thereto;

d. means carried by said spoke members for retaining the flexible tape in close proximity with said outer rim means; and e. means operatively associated with said retaining means and spoke members for sequentially displacing said retaining means to release the flexible tape while it is being extended from said tape wheel, and sequentially returning them to tape retaining position while the flexible tape is being wrapped about said tape wheel.

2. The improved tape wheel according to claim 1 wherein said retaining means defines a flexible guide member attached in opposed relation to each side of said spoke members.

3. The improved tape wheel according to claim 2 wherein said outer rim means includes locating members fixed in opposed relation on each side thereof and in alignment with said spoke members for controlling the location of said flexible guide members in their tape retaining position.

4. The improved tape wheel according to claim 2 wherein said displacing means defines an arcuated cam member for effecting movement of said flexible guide members between positions for retaining and releasing a flexible tape from said tape wheel.

5. The improved tape wheel according to claim 3 wherein said arcuated cam member is bifurcated defining a channel through which said outer rim means moves to effect simultaneous actuation of the opposed flexible guide members between their tape retaining and releasing positions.

* * * * *